US007325760B2

(12) United States Patent
Liu

(10) Patent No.: US 7,325,760 B2
(45) Date of Patent: Feb. 5, 2008

(54) AUTOMATIC GUIDED SYSTEM FOR TRANSFERRING SCRAP GLASS

(75) Inventor: Chi Sheng Liu, Taoyuan County (TW)

(73) Assignee: Hannstar Display Corp. (TW)

( * ) Notice: Subject to any disclaimer, the term of this patent is extended or adjusted under 35 U.S.C. 154(b) by 80 days.

(21) Appl. No.: 10/957,631

(22) Filed: Oct. 5, 2004

(65) Prior Publication Data

US 2005/0173575 A1 Aug. 11, 2005

(30) Foreign Application Priority Data

Feb. 6, 2004 (TW) ..... 93102850 A

(51) Int. Cl.
*B02C 19/00* (2006.01)

(52) U.S. Cl. ..... 241/101.2; 29/722; 414/222.01

(58) Field of Classification Search ..... 414/222.01; 241/101.2; 29/722
See application file for complete search history.

(56) References Cited

U.S. PATENT DOCUMENTS

| | | | | |
|---|---|---|---|---|
| 5,737,827 | A * | 4/1998 | Kuse et al. | 29/701 |
| 6,019,563 | A | 2/2000 | Murata et al. | |
| 6,268,900 | B1 | 7/2001 | Iwatsu | |
| 6,439,822 | B1 | 8/2002 | Kimura et al. | |
| 6,473,996 | B1 | 11/2002 | Tokunaga | |
| 6,593,045 | B2 | 7/2003 | Sato et al. | |

* cited by examiner

*Primary Examiner*—Mark Rosenbaum

(57) ABSTRACT

An automatic guided system transfers scrap glass resulted from at least one scrap glass source of a clean room to a scrap exit. The automatic guided system for transferring the scrap glass includes a rail module and a vehicle module. The rail module connects the scrap exit to the scrap glass source. The vehicle module is moved along the rail module for transferring the scrap glass from the scrap glass source to the scrap exit.

10 Claims, 11 Drawing Sheets

AUTOMATIC GUIDED SYSTEM FOR TRANSFERRING SCRAP GLASS

This application claims the priority benefit of Taiwan Patent Application Serial Number 093102850, filed Feb. 6, 2004, the full disclosure of which is incorporated herein by reference.

BACKGROUND OF THE INVENTION

1. Field of the Invention

The present invention generally relates to an automatic guided system, and more particularly to an automatic guided system for transferring scrap glass, and the automatic guided system is capable of decreasing the wasted space of the first fabrication area (FAB) in a clean room and reducing the manpower cost.

2. Description of the Related Art

Referring to FIG. 1, it depicts the arrangement of each level of a clean room. The clean room 10 includes a second fabrication area (SUB-FAB) 22 located on the first level 12, a first fabrication area (FAB) 24 located on the second level 14, and an air chamber 26 located on the third level 16. The second fabrication area 22 is an air return area or an area for accommodating pipes and auxiliary manufacturing apparatuses. The first fabrication area 24 is located above the second fabrication area 22 for accommodating primary manufacturing apparatuses. The air chamber 26 is located above the first fabrication area 24 for sucking flesh air from the outside of the clean room. An air circulating system 28 is installed on the first level 12 or the third level 16 for regulating the temperature and humidity and generating airflow, shown as the arrow in FIG. 1.

Recently, according to a clean room for manufacturing a liquid crystal display, human workers collect scrap glass, such as an entire scrap glass substrate or the scrap edge of a glass substrate. For example, according to a method for collecting the edge scrap of a glass substrate, a glass cutting apparatus for cutting a glass substrate is generally provided with a scrap box located thereunder. After the scrap box is full of the scrap glass, the scrap box will be pushed and moved to a warehouse by human worker.

However, according to the above-mentioned method for collecting the scrap glass, the scrap box can occupy the space of the first fabrication area. Also, it is not easy to control when the scrap box is full of the scrap glass, and therefore the human work need to patrol, inspect and transfer the scrap box regularly, such that the manpower cost is increased. Furthermore, when the scrap glass is collected into the scrap box, it possibly pollutes the clean room. In addition, the scrap box full of the scrap glass is too heavy to be easily transferred and will easily harm the human worker. If the production quantity of the liquid crystal display is increased, the number of the glass cutting apparatus and the scrap box are increased and the area of the clean room is enlarged, thereby further increasing the manpower cost.

Recently, an automatic guided system is widely applied to the manufacturing industry. For example, an automatic guided vehicle or a rail-guided vehicle is usually utilized in the clean room for transferring work for manufacturing a semiconductor device or a flat panel display (FPD), such as a liquid crystal display. U.S. Pat. No. 6,019,563, entitled "Automatic Guided Vehicle" issued to Murata et al. on Feb. 1, 2000, discloses an automatic guided vehicle or a rail guided vehicle including light sensors can safely, certainly and rapidly finish the transferring work.

Accordingly, there exists a need for an automatic guided system for transferring scrap glass for solving the above-mentioned problem of the transferring work of the human worker.

SUMMARY OF THE INVENTION

It is an object of the present invention to provide an automatic guided system for transferring scrap glass, wherein the automatic guided system decreases the wasted space of the first fabrication area (FAB) and the manpower cost by utilizing automatically transferring the scrap glass in the second fabrication area (SUB-FAB).

The present invention provides an automatic guided system for transferring scrap glass resulted from at least one scrap glass source of a clean room to a scrap exit. The automatic guided system for transferring the scrap glass includes a rail module and a vehicle module. The rail module connects a first predetermined location to a second predetermined location. The first predetermined location is a garage for providing the vehicle module to await an order or a collecting workstation for treating the scrap material resulted from the scrap source. The second predetermined location is a scrap exit for providing the vehicle module to dump the scrap material resulted from the scrap source or a collecting workstation for treating the scrap material resulted from the scrap source. The vehicle module is disposed and moved along the rail module for transferring the scrap glass from the scrap glass source to the scrap exit The automatic guided system for transferring scrap glasses according to the present invention can decrease the wasted space of the first fabrication area and avoid interfering with the movement of the first fabrication area. Furthermore, the automatic guided system can collect the bigger scrap glass and shatter the scrap glass, thereby preventing the human worker from harm. In addition, the automatic guided system can reduce the manpower cost, and the automatic guided system does not increase the manpower cost when the production quantity is increased.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
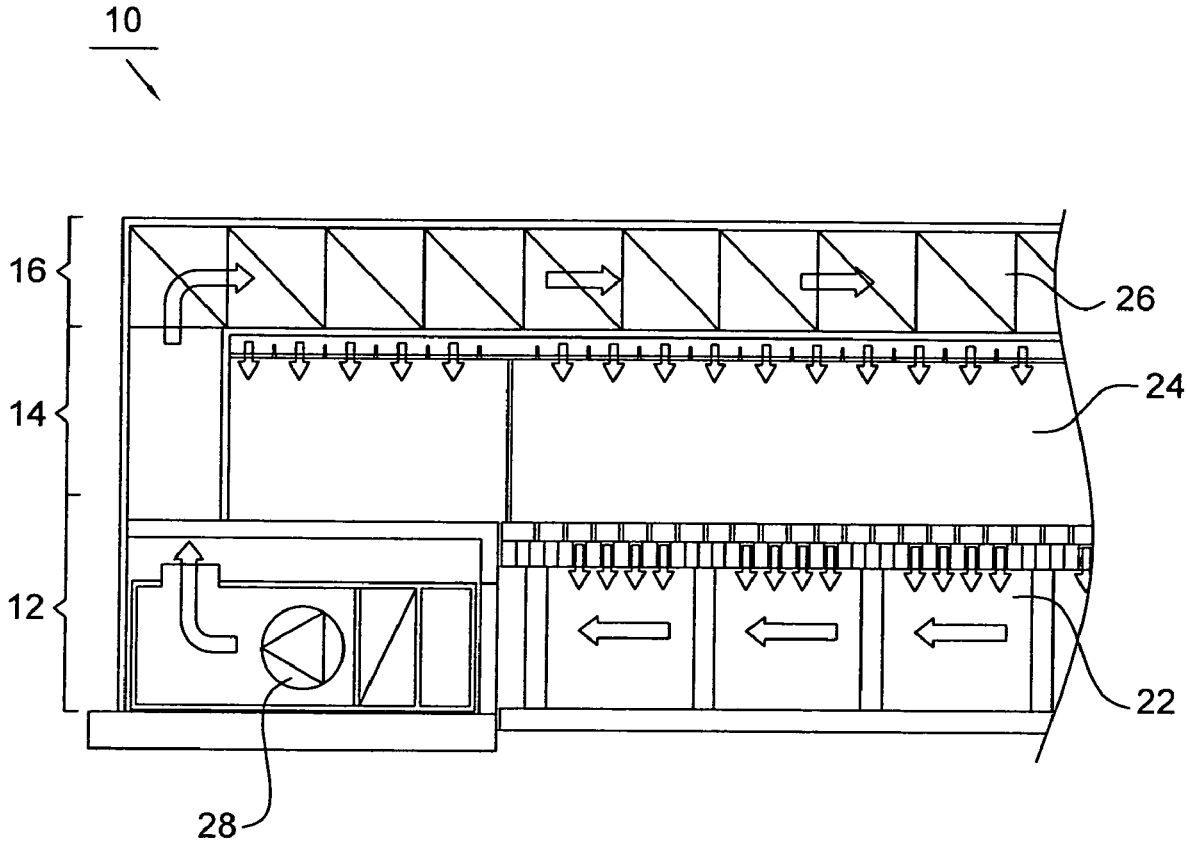
FIG. 1 (PRIOR ART)
FIG. 1 is a cross-sectional schematic view showing the arrangement of each level of a clean room in the prior art.
Figure 2:
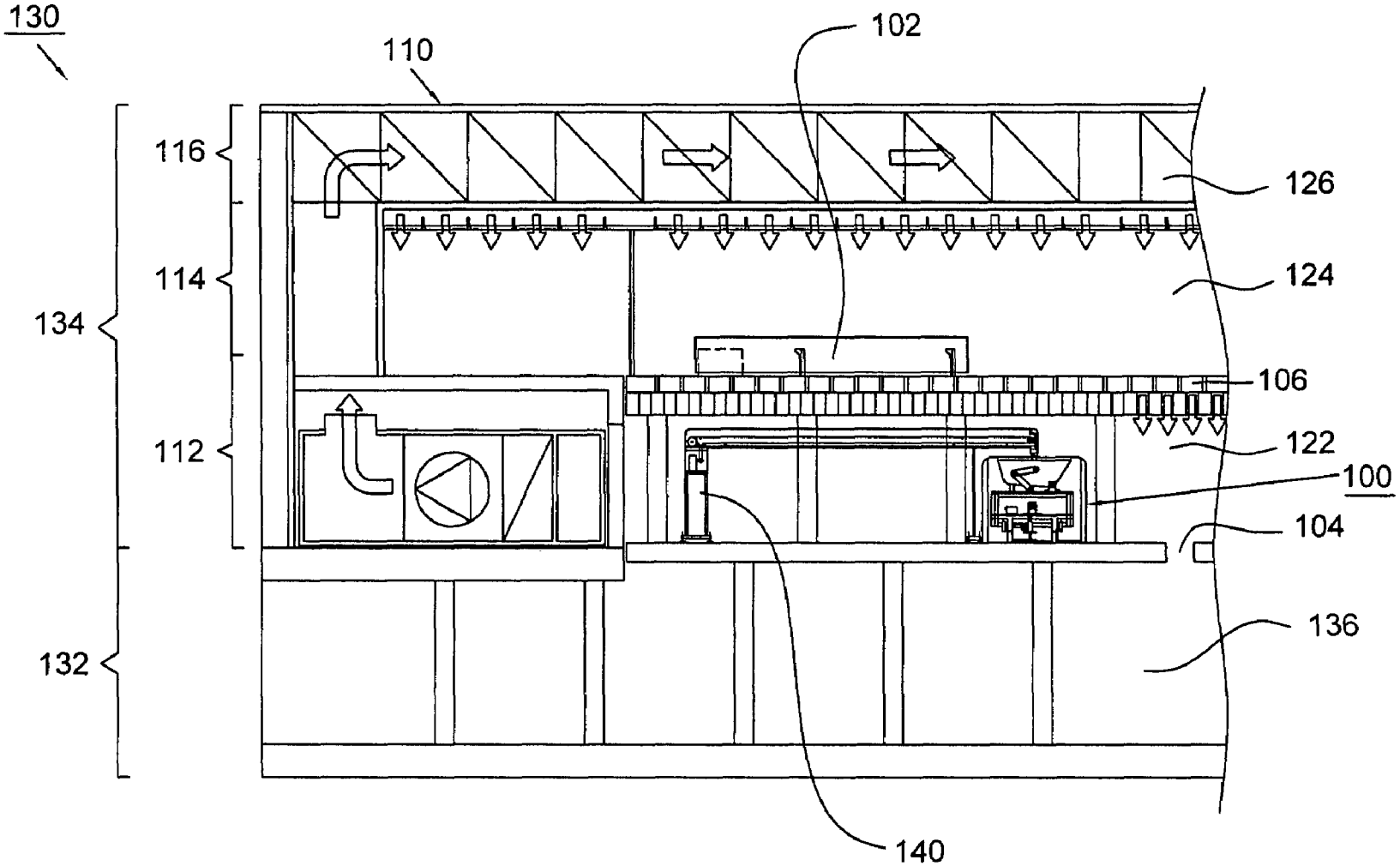
FIG. 2 is a cross-sectional schematic view showing the arrangement of each level of a clean room with an automatic guided system for transferring scrap material according to an embodiment of the present invention.

Referring to FIG. 2, it depicts a building 130 that includes a clean room 110 for manufacturing liquid crystal displays and an automatic guided system 100 for transferring scrap material according to an embodiment of the present invention. The scrap material is resulted from a scrap source of the clean room. The scrap material can be scrap glass. The automatic guided system 100 collects the scrap glass resulted from a plurality of glass cutting apparatus 102 of the clean room 110 and then transfers them to a scrap exit 104. The clean room 110 includes a second fabrication area (SUB-FAB) 122 located on the first level 112, a first fabrication area (FAB) 124 located on the second level 114, and an air chamber 126 located on the located on the third level 116. The second fabrication area 122 is an air return area or an area for accommodating pipes and auxiliary manufacturing apparatuses. The first fabrication area 124 is located above the second fabrication area 122 for accommodating primary manufacturing apparatuses. The air chamber 126 is located above the first fabrication area 124 for sucking flesh air from the outside of the clean room and generating an air flow, shown as the arrow in FIG. 2. The glass cutting apparatus 102 is disposed on a raised floor 106 of the first fabrication area 124. The scrap exit 104 is a through opening and disposed on the floor between the first floor 132 and the second floor 134 of the building 130.

Furthermore, the clean room 110 can be located on the second floor 134 of the building 130, and the space of the first floor 132 of the building 130 can be utilized for other use, such as a warehouse 136 located on the first floor 132. More detailed, the building 130 is constructed by steel frame reinforce concrete or steel bar reinforce concrete and has a plurality of floors. The clean room 110 is located on one of the floors, and the scrap exit 104 goes through the next floor.

Figure 3:
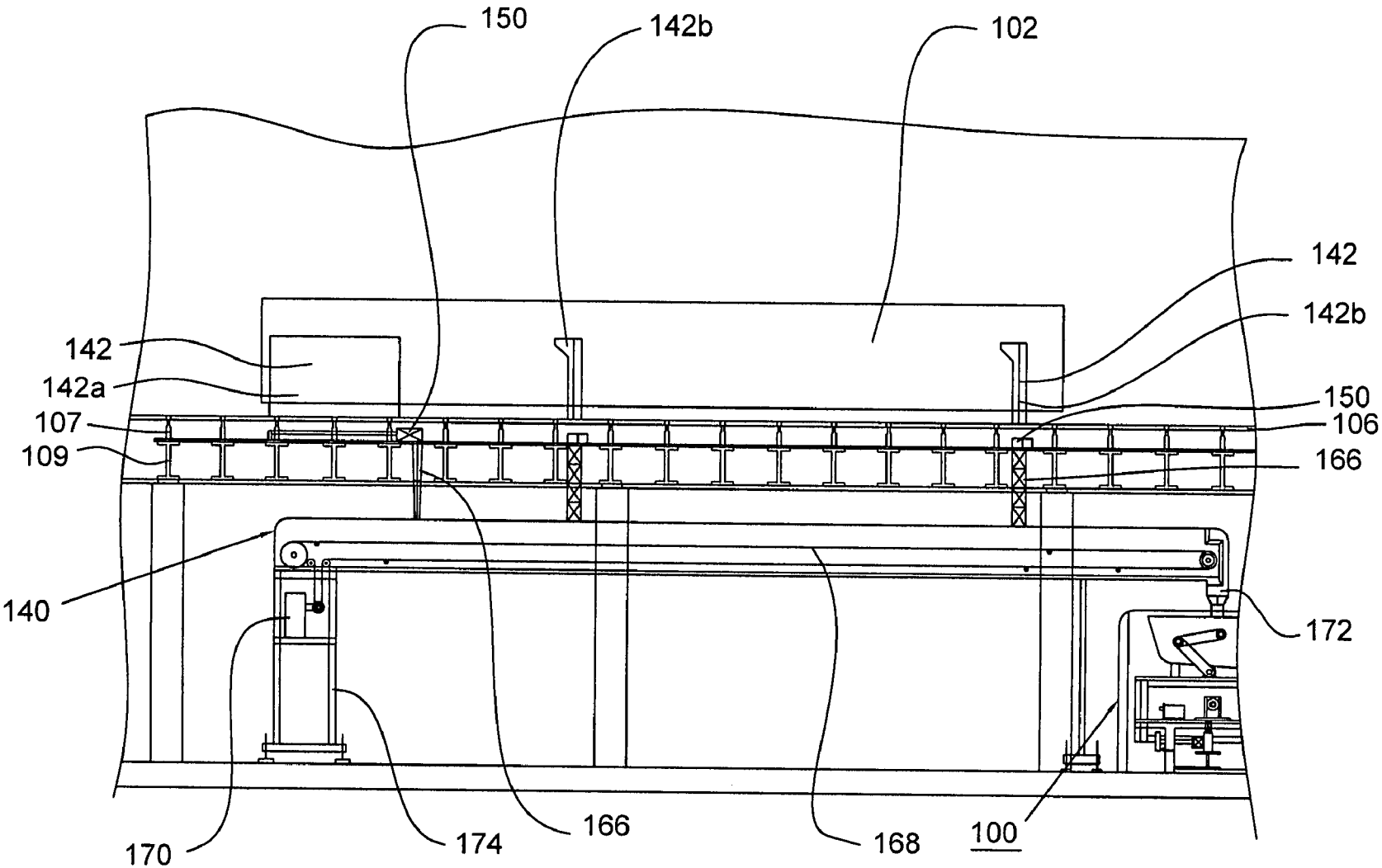
FIG. 3 is a side schematic view of a collecting workstation of the automatic guided system according to an embodiment of the present invention.

Referring to FIG. 3, the automatic guided system 100 includes a plurality of collecting workstations 140 which are disposed under the glass cutting apparatuses 102 for treating the scrap glass. More detailed, the collecting workstations 140 are disposed in the second fabrication area 122, i.e., the automatic guided system 100 is disposed under the raised floor 106 of the first fabrication area 124 and in the second fabrication area 122. The glass cutting apparatus 102 includes a plurality of scrap glass outlets which each has a funnel 142 for collecting the scrap glass 164 resulted from the glass cutting apparatus 102, shown in FIG. 4. For example, the glass cutting apparatus 102 has four cutting processes for cutting the scrap edge of a glass substrate and being corresponding to four funnels 142 to be requested, e.g. two longitudinal funnels 142*a* and two latitudinal funnels 142*b*. The raised floor 106 has openings corresponding to the outlets of the funnels 142, whereby the scrap glass can go through the opening and drop into the collecting workstation 140.

Figure 4:
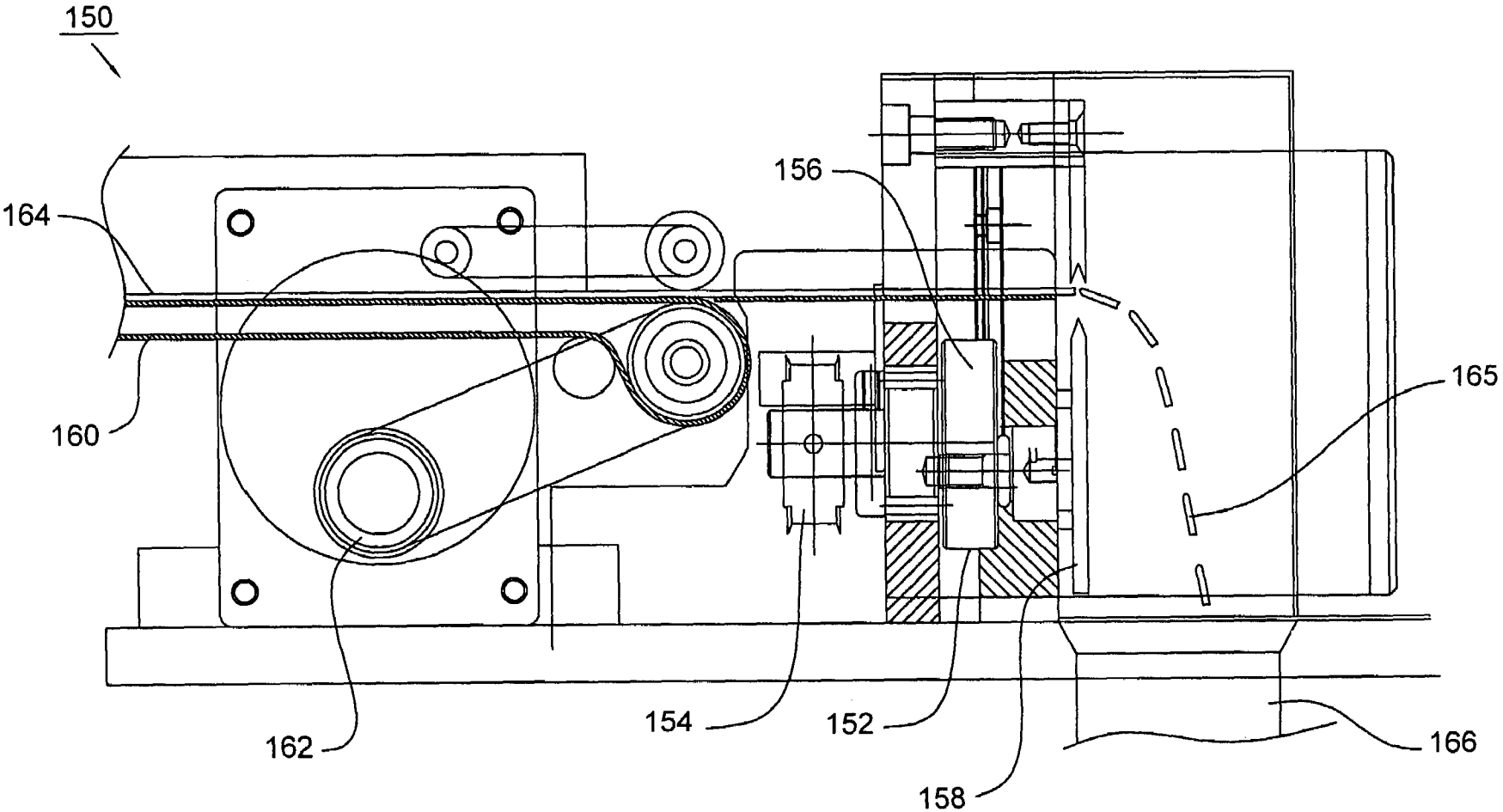
FIG. 4 is a cross-sectional schematic view of a shattering means of the automatic guided system according to an embodiment of the present invention.

Referring to FIG. 3 and FIG. 4, the collecting workstation 140 includes a plurality of shattering means 150 disposed under the funnels 142 for collecting and shattering the scrap glass 164 that is dumped from the funnels 142. The shattering means 150 includes a first conveying belt 160 and a pulsing unit 152 for shattering the scrap glass 164. The first conveying belt 160 is disposed under the funnels 142 and driven by a driving unit 162, and transfers the scrap glass 164 to the pulsing unit 152. The pulsing unit 152 includes a crank driving motor 154, a crank 156 (or an eccentric wheel) connected to the crank driving motor 154, and a pulsing plate 158 connected to the crank 156. The crank 156 transforms the rotational motion of the crank driving motor 154 to the linear motion of the pulsing plate 158, thereby chattering the scrap glass 164 to be scrap bits 165.

Referring to FIGS. 3 and 4 again, the collecting workstation 140 further includes a plurality of path means 166 respectively connected to the shattering means 150 for collecting the scrap bits 165. The collecting workstation 140 further includes a second conveying belt 168 disposed under the path means 166, such that the scrap bits 165 dumped from the path means 166 drop to the second conveying belt 168. A driving motor 170 drives the second conveying belt 168, such that the scrap bits 165 on the second conveying belt 168 are transferred into a storage means 172. The storage means 172 is provided with a pressure sensor (not shown) for measuring the weight of the scrap bits 165, such that the pressure sensor outputs a signal to the automatic guided system 100 when there is a predetermined quantity of the scrap bits 165 in the storage means 172 to be collected. The collecting workstation 140 further includes a supporting frame 174 for supporting the second conveying belt 168, the driving motor 170 and the storage means 172.

As shown in FIG. 2, the collecting workstation 140 is disposed in the second fabrication area 122. Also, the raised floor 106 of the first fabrication area 124 is supported on a plurality of H beams 109 by a plurality of supports 107, and the shattering means 150 is disposed in the space formed by the support 107. In other words, the shattering means 150 is disposed between the raised floor 106 of the first fabrication area 124 and the H beams 109 and is lower than the support 107 in height, and therefore the shattering means 150 shouldn't affect the structure of the first fabrication area 124.

Figure 5:
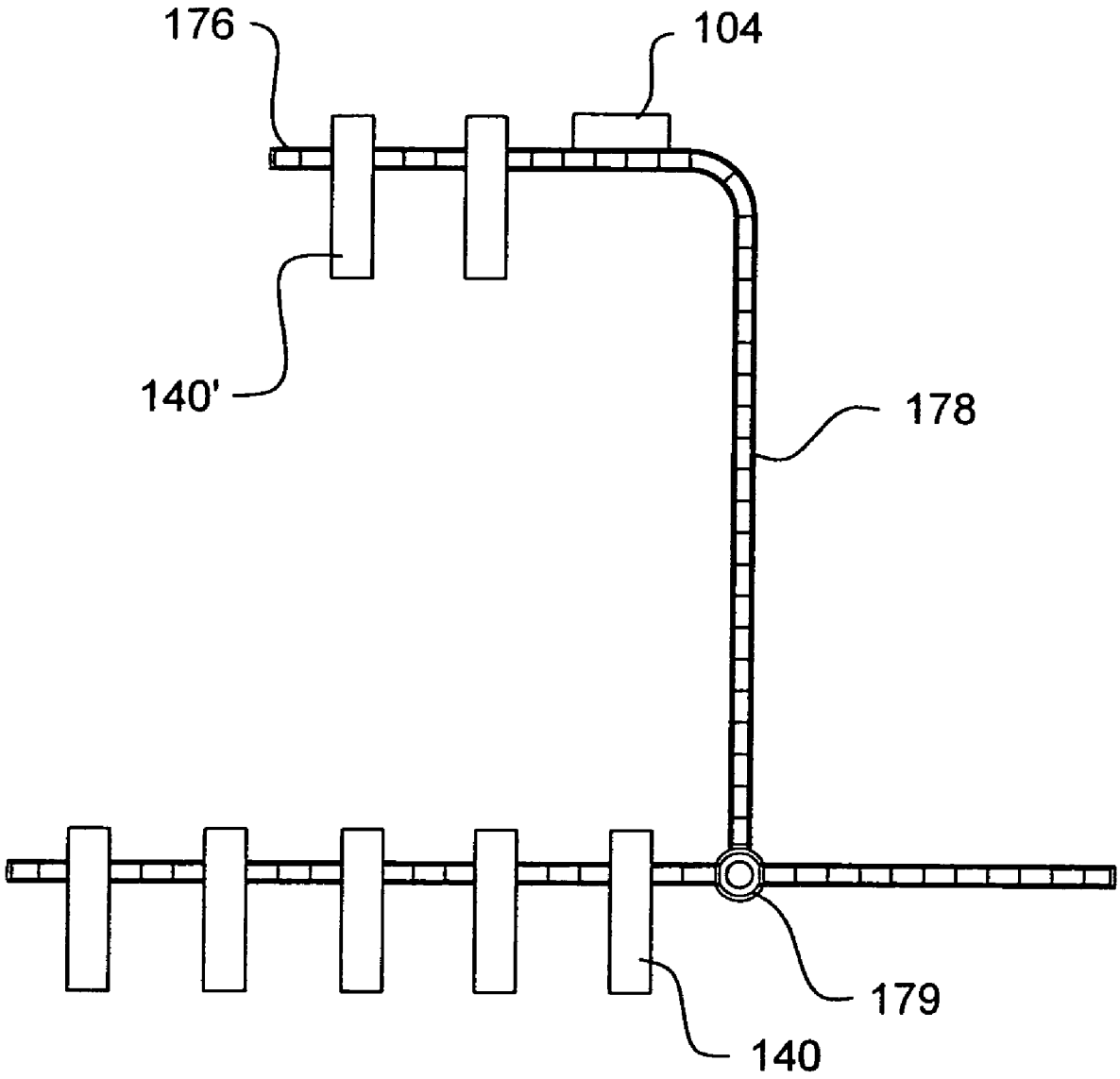
FIG. 5 is a plane schematic view of a rail module of the automatic guided system according to an embodiment of the present invention.
Figure 6:
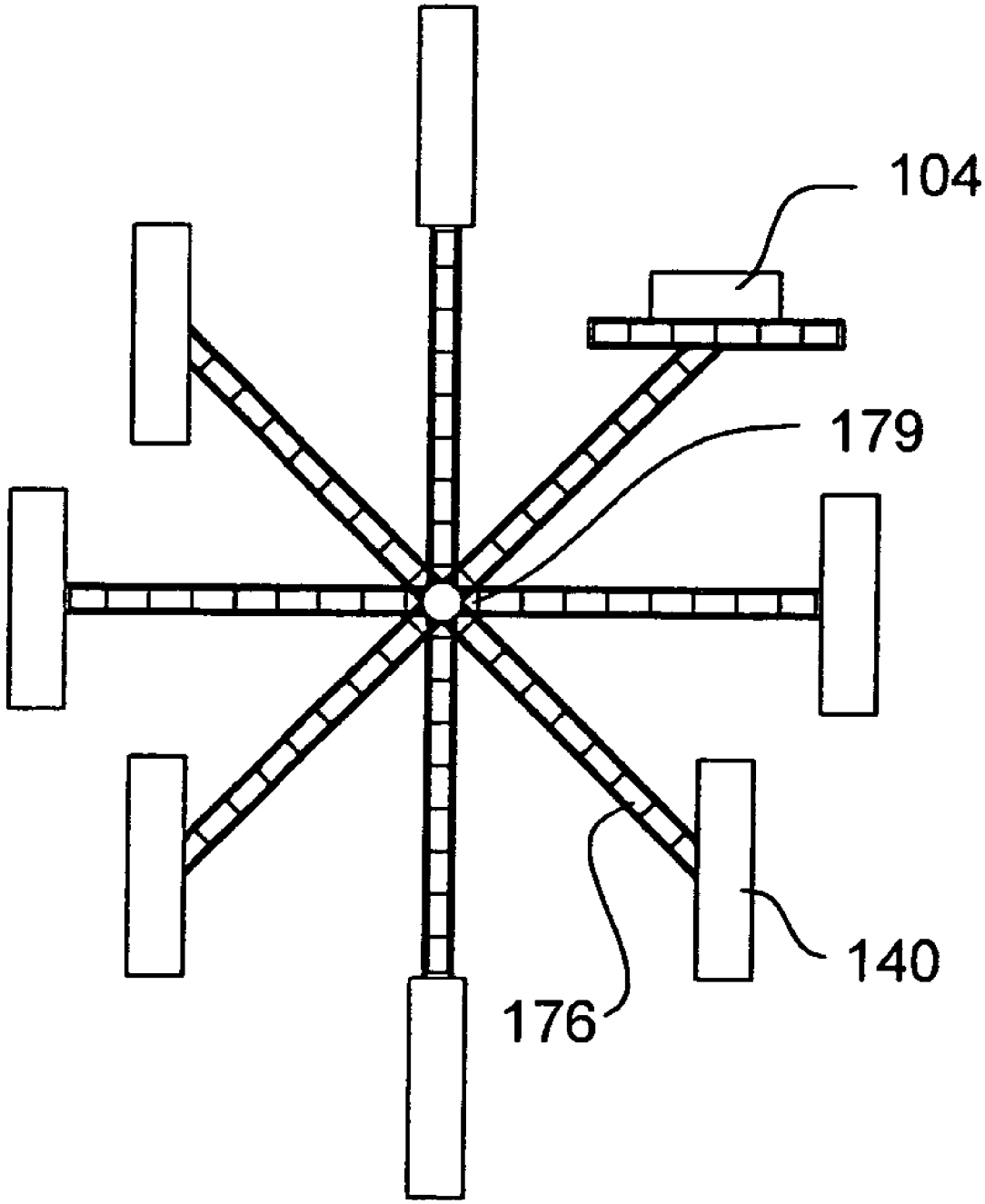
FIG. 6 is a plane schematic view of another rail module of the automatic guided system according to an embodiment of the present invention.
Figure 7:
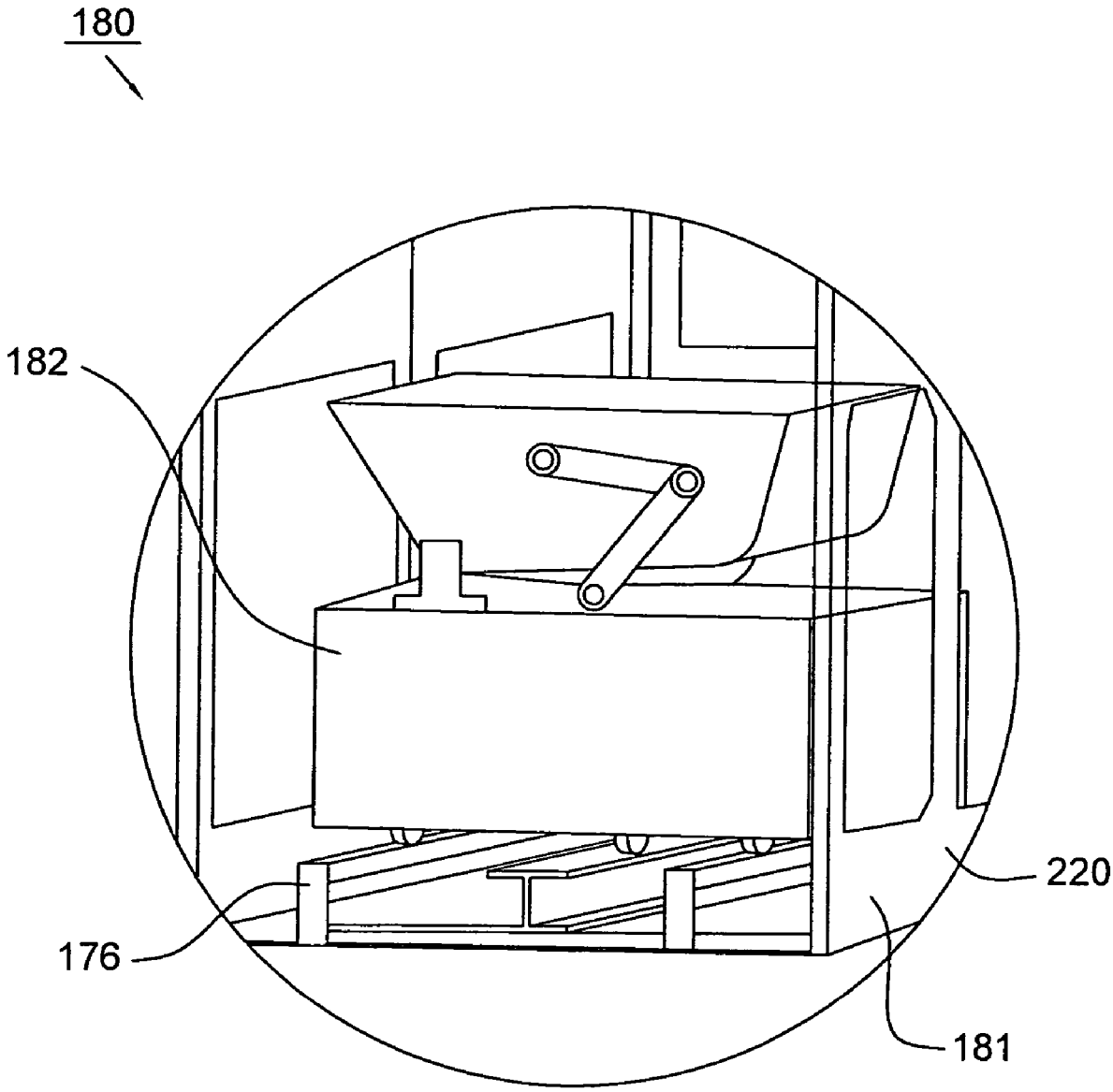
FIG. 7 is a perspective schematic view of a vehicle module of the automatic guided system according to an embodiment of the present invention.

Referring to FIG. 5 the automatic guided system 100 further includes a rail module 176 for connecting the scrap exit 104 to the collecting workstations 140. It is apparent to one of ordinary skill in the art that the arrangement of the rail module 176 depends on the arrangement of the collecting workstations 140, such as radiative type arrangement, shown in FIG. 6. The rail module 176 includes a rail unit 178 and an electric rail (not shown) disposed along and in the rail unit 178. The rail unit 178 is used for guiding a motion direction of the vehicle module 180. The electric rail supplies electric power to a vehicle module 180, shown in FIG. 7. A rotational means 179 disposed on the rails 178 for changing the direction of the vehicle module 180.

Referring to FIG. 7 again, the vehicle module 180 is disposed and moved along the rail module 176. The vehicle module 180 includes a vehicle body 182 and a programmable controller (not shown) disposed in the vehicle body 182. The programmable controller is written with software of process control for controlling the vehicle module 180 to collect the scrap bits 165 dumped from each storage means 172 and then transferring the scrap bits 165 to the scrap exit 104 when the collecting work is finished. Also, the rail modules 176 further include a dust-proof case 181 of a cover unit 220 which is disposed along and cover the rails 178, shown in FIG. 11.

It is apparent to one of ordinary skill in the art that the scrap glass can be the scrap edge of a glass substrate that is collected from the glass cutting apparatus 102 or an entire scrap glass substrate with bad product. The entire scrap glass substrate is typically transferred from the automatic guided vehicle (not shown) of the first fabrication area 124 to a predetermined location. Referring to FIG. 5 again, the rail module 176 are further extended to a plurality of collecting workstations 140' which are corresponding to the predetermined location for collecting the entire scrap glass substrate.

Figure 8:
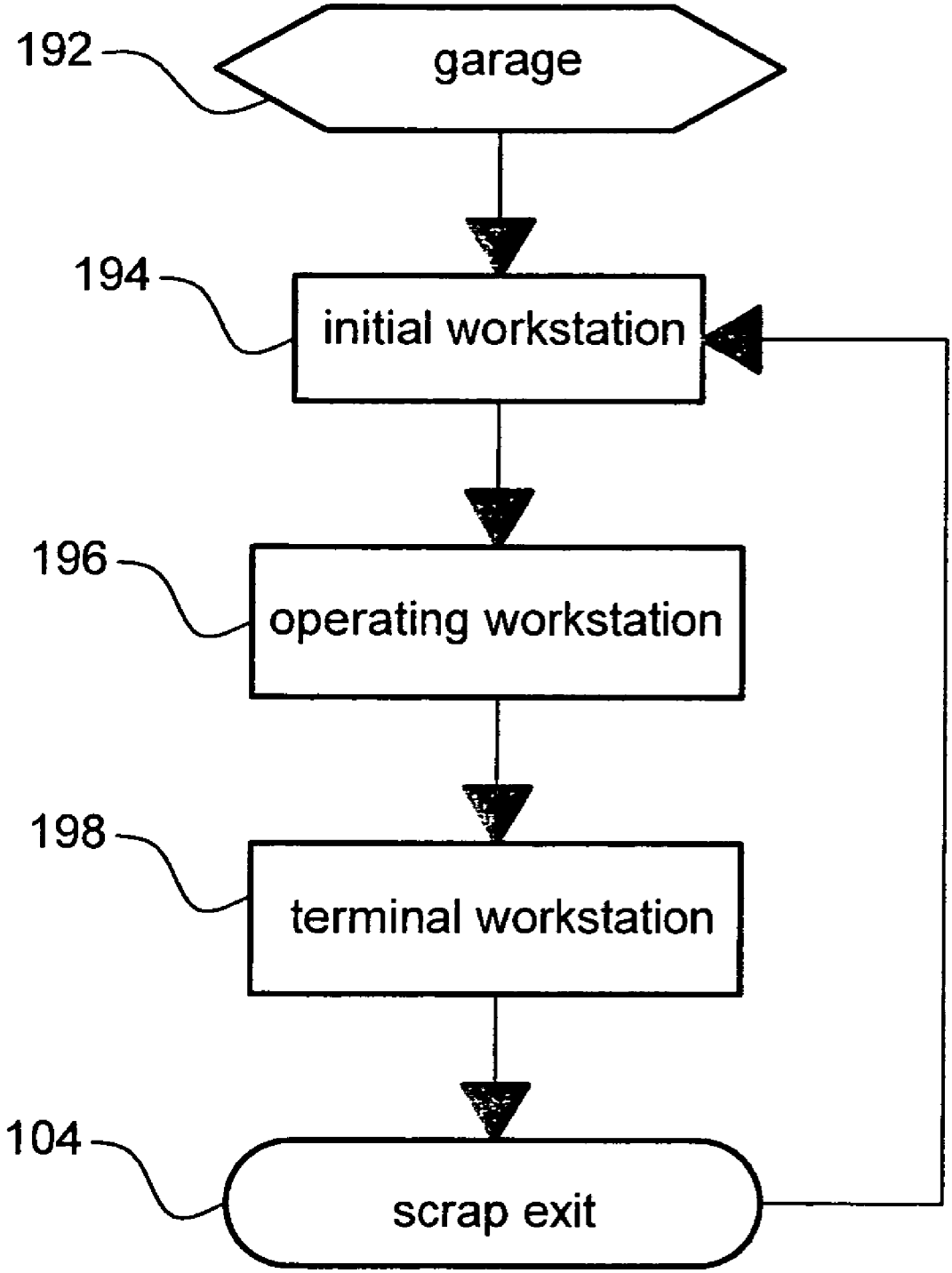
FIG. 8 is a flow diagram showing a collecting process of a vehicle module of the automatic guided system according to an embodiment of the present invention.

As shown in FIG. 8, it depicts the collecting process of the vehicle module 180 according to the prevent invention. When the automatic guided system 100 in a standby state, the vehicle module 180 awaits an order in a garage 192. One of the collecting workstations 140 is set up to be an initial workstation 194 for acting as an initial location of the circulative collecting process of the vehicle module 180. Another one of the collecting workstations 140 is set up to be a terminal workstation 198 for acting as a terminal location of the circulative collecting process of the vehicle module 180. Others of the collecting workstations 140 are set up to be operating workstations 196 for acting as intermediate locations of the circulative collecting process of the vehicle module 180. The vehicle module 180 collects the scrap glass dumped from the initial workstation 194, the operating workstations 196 and the terminal workstation 198 in sequence, and then dumps the scrap glass to the scrap exit 104, thereby finishing a circulative collecting process.

The circulative time and frequency of a cycle of the circulative collecting process depend on the quantity of the scrap glass of the collecting workstations 140. It is apparent to one of ordinary skill in the art that the circulative collecting process of the vehicle module 180 is not only for a fixing route but also for only being set up to collect the scrap glass of the collecting workstations 140 which is corresponding to the glass cutting apparatus 102 or for being set up to firstly collecting the scrap glass of the collecting workstations 140 with huge quantity of the scrap glass. Otherwise, the programmable controller of the vehicle module 180 also receives the pressure signal outputted from the pressure sensor of the storage means 172, thereby automatically judging whether the vehicle module 180 collects some collecting workstations 140 or not.

Figure 10:
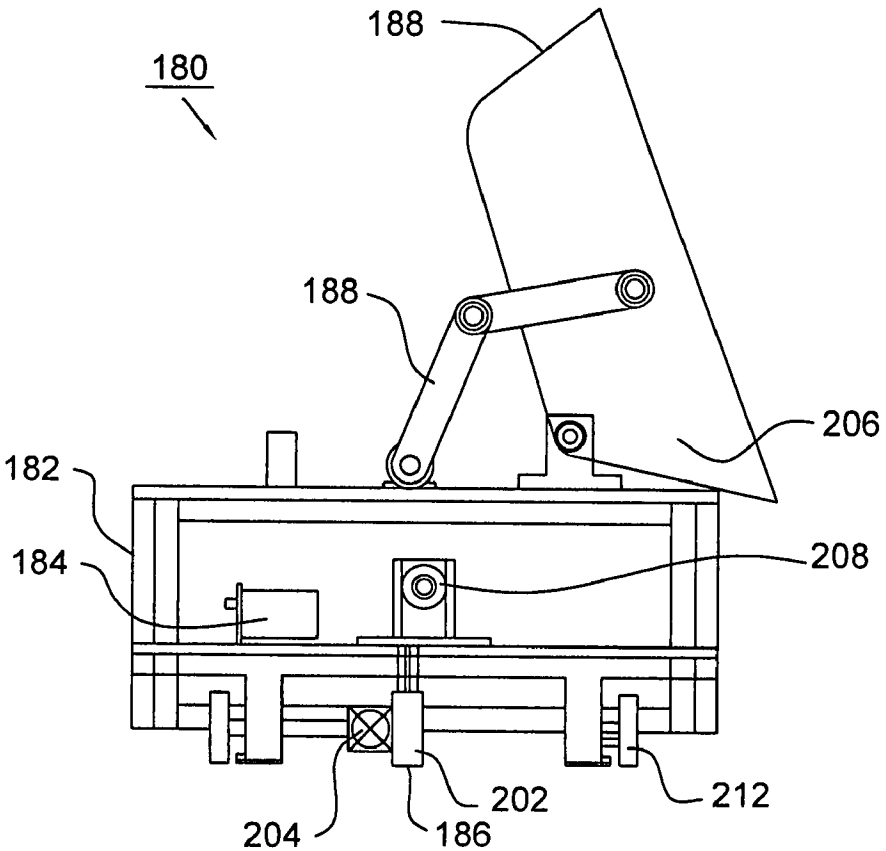
FIG. 10 is a side schematic view of a vehicle module of the automatic guided system according to an embodiment of the present invention.
Figure 9:
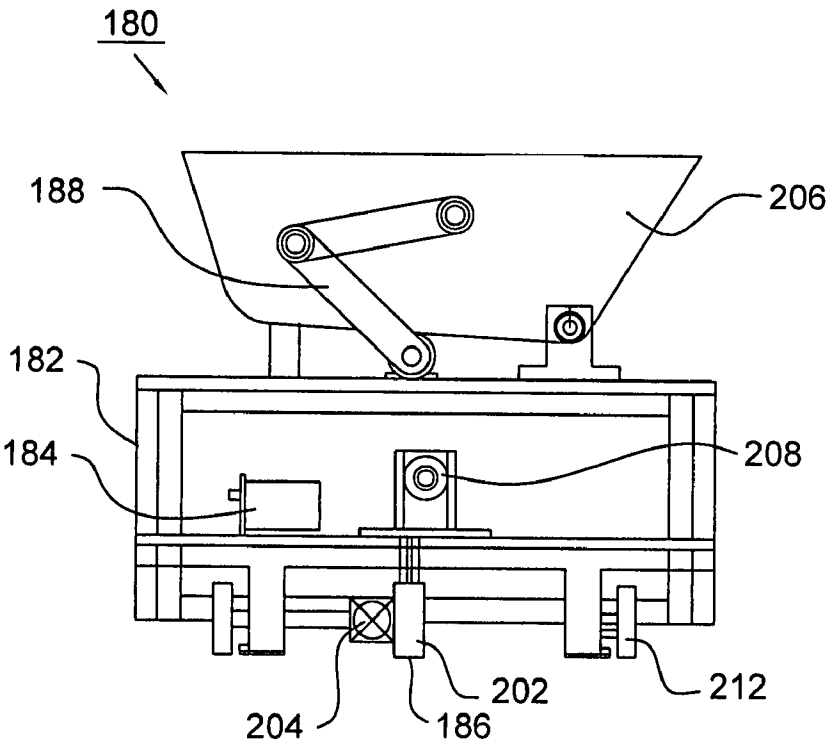
FIG. 9 is a side schematic view of a vehicle module of the automatic guided system according to an embodiment of the present invention.

Referring to FIG. 9 again, the programmable controller 184 disposed in the vehicle body 182 for controlling a driving mechanism 186 and an overturning mechanism 188 disposed under the vehicle body 182. The driving mechanism 186 includes a driving wheel 202 and a vehicle driving motor 204. The vehicle driving motor 204 is disposed in the vehicle body 182 for driving the driving wheel 202 and further driving the vehicle module 180 forward and backward. The overturning mechanism 188 includes a scoop 206 and an overturning motor 208. The scoop 206 is pivotally connected to the vehicle body 182 for supporting the scrap glass, and the overturning motor 208 drives the scoop 206 for inclining the scoop 206, shown in FIG. 10, or for horizontally keeping the scoop 206, shown in FIG. 9. A plurality of guided wheels 212 are connected to the vehicle body 182 for guiding the vehicle module 180 moving along the rail module 176. The vehicle module 180 is provided with an electric brush (not shown) that is electrically connected to the electric rail for supplying the electric power to the vehicle module 180.

Figure 11:
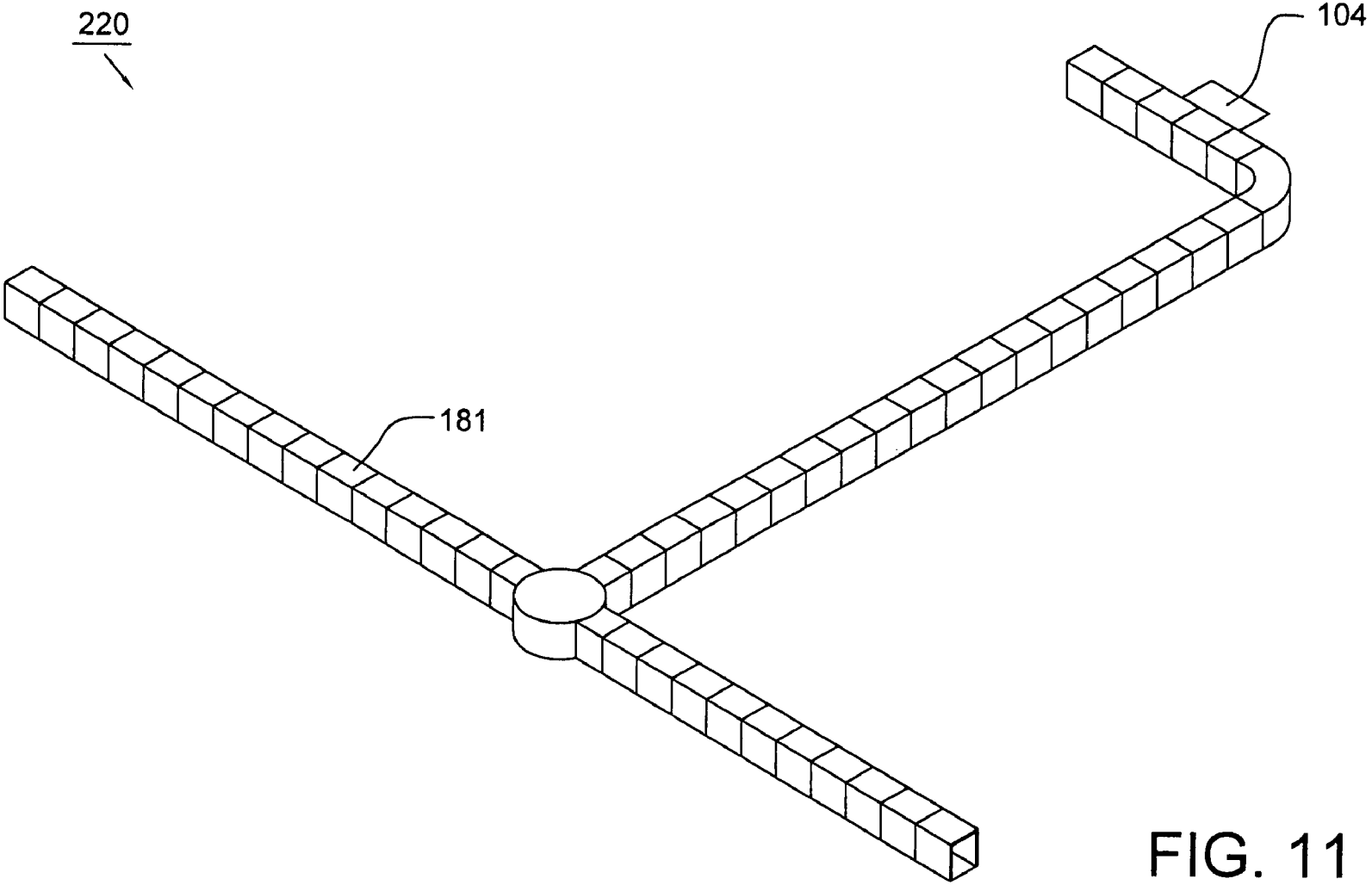
FIG. 11 is a perspective schematic view of a cover unit of the automatic guided system according to an embodiment of the present invention.

Referring to FIG. 11, the cover unit 220 that has the dust-proof case 181 substantially to cover the rail module 176. The vehicle module 180 is moved in the dust-proof case 181 for preventing the second fabrication area 122 from fine particle, fine dust and scrap bit 165 or the like during the motion of the vehicle module 180 and further polluting the clean room.

Figure 12:
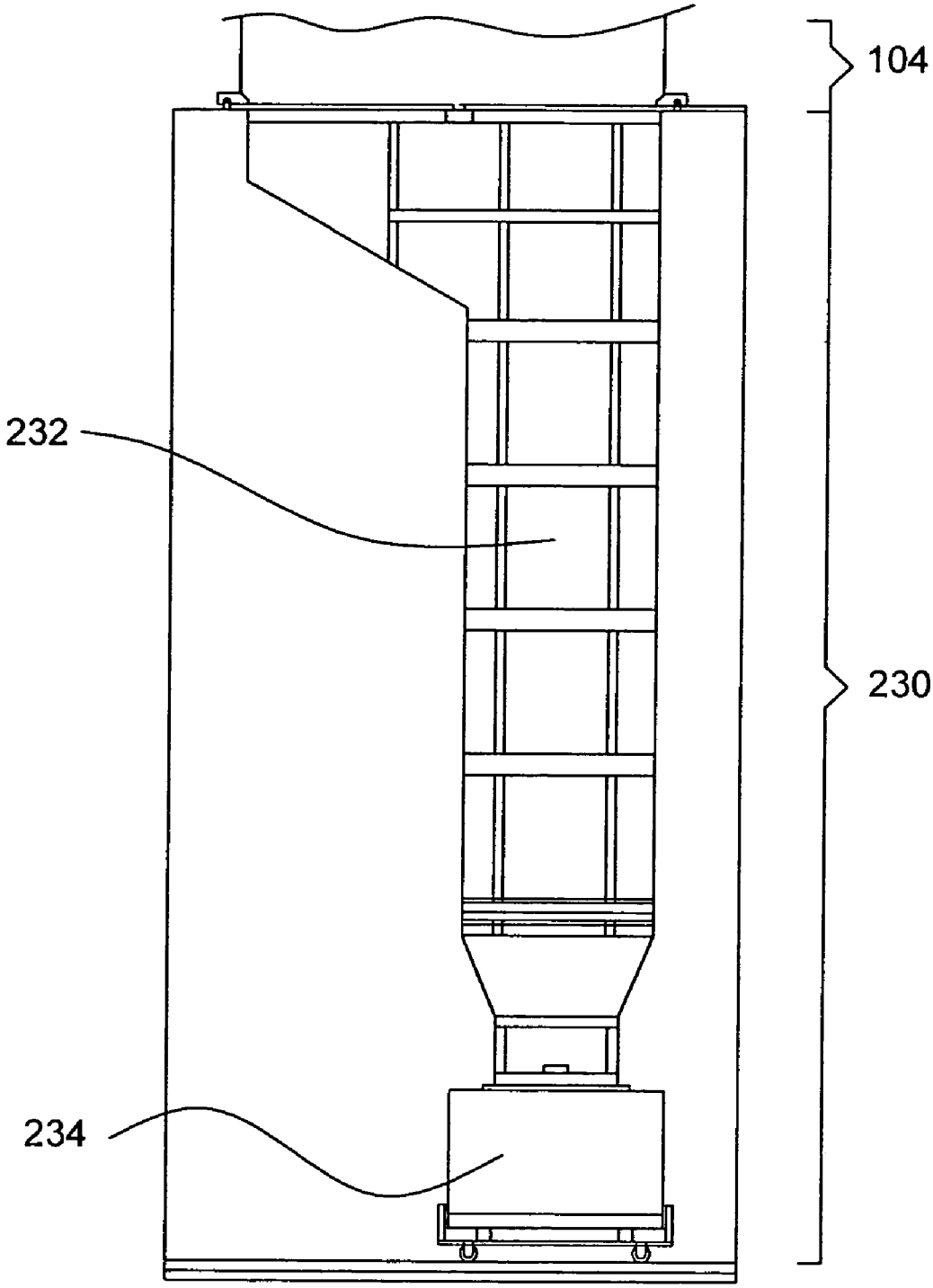
FIG. 12 is a side schematic view of a dumping apparatus of the automatic guided system according to an embodiment of the present invention.

It is apparent to one of ordinary skill in the art that the automatic guided system 100 further includes a wireless control module (not shown) for further controlling the vehicle module 180. The rail module 176 can be provided with a plurality of positioning sensor (not shown) for slowing down the vehicle module 180. Referring to FIG. 12, the automatic guided system 100 further includes a dumping apparatus 230 that has a dumping pipe 232 and a dumping tank 234. The dumping pipe 232 is connected to the scrap exit 104, and the dumping tank 234 is disposed under the dumping pipe 232. The dumping pipe 232 can be constituted by a steel pipe and a plurality of buffer (not shown). After the vehicle module 180 dumps the scrap glass to the scrap exit 104, the scrap glass will pass through the dumping pipe 232 and then be stored in the dumping tank 234. When there is a predetermined volume or weight of the scrap glass, the dumping tank 234 is transported to another place by utilizing a transferring truck.

As compared with prior art, the automatic guided system for transferring scrap glasses according to the present invention can decrease the wasted space of the first fabrication area and avoid interfering with the movement of the first fabrication area. Furthermore, the automatic guided system can collect the bigger scrap glass and shatter the scrap glass, thereby preventing the human worker from harm. In addition, the automatic guided system can reduce the manpower cost, and the automatic guided system does not increase the manpower cost when the production quantity is increased.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A clean room comprising:

a first fabrication area and a second fabrication area, wherein the first fabrication area disposed in the clean room for accommodating primary manufacturing apparatuses, the second fabrication area disposed in the clean room and under the first fabrication area; and an automatic guided system transferring scrap material from a scrap source in the first fabrication area and comprising:

a first predetermined location configured to have a proximate relationship with the scrap source;

a second predetermined location whereat the scrap material is dumped;

a rail module disposed in the second fabrication area for connecting the first predetermined location to the second predetermined location; and a vehicle module disposed in the second fabrication area and moved along the rail module for transferring the scrap material from the first predetermined location to the second predetermined location.

2. The automatic guided system as claimed in claim 1, wherein the scrap material resulted from the scrap source is scrap glass, and the scrap glass is an entire scrap glass substrate.

3. The automatic guided system as claimed in claim 1, further comprising a collecting workstation connected to the rail module and disposed between the first predetermined location and the second predetermined location for treating the scrap material resulted from the scrap source.

4. The automatic guided system as claimed in claim 3, the scrap collecting workstation comprises:

a first conveying belt connected to the scrap source for conveying the scrap material resulted from the scrap source;

a shattering device connected to the first conveying belt for shattering the scrap material resulted from the scrap source to be a plurality of scrap bits;

a path structure connected to the shattering device for dumping the scrap bits shattered by the shattering device;

a second conveying belt connected to the path structure for conveying the scrap bits dumped from the path structure; and a storage device connected to the second conveying belt for storing the scrap bits conveyed by the second conveying belt.

5. The automatic guided system as claimed in claim 4, wherein the shattering device comprises a pulsing unit for shattering the scrap material resulted from the scrap source, wherein the pulsing unit comprises: a crank; a crank driving motor connected to the crank for driving the crank; and a pulsing plate connected to the crank for shattering the scrap material resulted from the scrap source into the scrap bits.

6. The automatic guided system as claimed in claim 1, wherein the vehicle module comprises:

a vehicle body;

a vehicle driving motor disposed in the vehicle body for driving the vehicle body;

an overturning mechanism disposed on the vehicle body including a scoop and an overturning motor, wherein the scoop pivotally connected to the vehicle body for supporting the scrap material resulted from the scrap source, and the overturning motor for driving the overturning mechanism to overturn the scoop; and a programmable controller disposed in the vehicle body for controlling the vehicle driving motor and the overturning motor.

7. The automatic guided system as claimed in claim 6, wherein the vehicle module further comprises a guided wheel connected to the vehicle body for guiding the vehicle module moving along the rail module.

8. The automatic guided system as claimed in claim 1, wherein the rail module comprises:

a rail unit for guiding a motion direction of the vehicle module;

an electric rail disposed along and in the rail unit for supplying electric power to the vehicle module; and a cover unit disposed along and cover the rail unit for avoiding pollution caused by the motion of the vehicle module.

9. The automatic guided system as claimed in claim 8, wherein the rail module further comprises a rotational device disposed on the rail unit for changing the motion direction of the vehicle module.

10. The automatic guided system as claimed in claim 1, wherein the scrap material resulted from the scrap source is scrap glass, and the scrap glass is a scrap edge of a glass substrate.

* * * * *